United States Patent [19]

Nixon

[11] 4,036,161

[45] July 19, 1977

[54] UNDERWATER ANCHORING APPARATUS

[75] Inventor: Ralph Alan Nixon, Hamilton, Scotland

[73] Assignee: The Secretary of State for Industry in Her Britannic Majesty's Government of the United Kingdom of Great Britain & Northern Ireland, London, England

[21] Appl. No.: 656,884

[22] Filed: Feb. 10, 1976

Related U.S. Application Data

[62] Division of Ser. No. 453,638, March 21, 1974, Pat. No. 3,967,393.

[30] Foreign Application Priority Data

July 4, 1973 United Kingdom ..... 31935/73

[51] Int. Cl.[2] ..... B63B 21/27

[52] U.S. Cl. ..... 114/296; 61/99

[58] Field of Search ..... 114/294–296; 61/53.5, 86, 98, 99

[56] References Cited

U.S. PATENT DOCUMENTS

| | | | |
|---|---|---|---|
| 2,895,301 | 7/1959 | Casagrande | 61/46.5 |
| 3,496,900 | 2/1970 | Mott et al. | 114/206 R |
| 3,817,040 | 6/1974 | Stevens | 114/206 R |

*Primary Examiner*—Trygve M. Blix
*Assistant Examiner*—Stuart M. Goldstein
*Attorney, Agent, or Firm*—Cameron, Kerkam, Sutton, Stowell & Stowell

[57] ABSTRACT

The invention concerns an apparatus for establishing an anchorage in the bed of a liquid. The apparatus comprises essentially a substantially hollow structure into which solids from the liquid bed are induced as solids in liquid suspension. When the apparatus is being used as an anchoring device the design is such that as solids from the liquid bed are induced into the substantially hollow structure they fill or partially fill the structure which then proceeds to bury itself into the liquid bed thereby establishing an anchorage.

9 Claims, 4 Drawing Figures

UNDERWATER ANCHORING APPARATUS

This is a division, of application Ser. No. 453,638, filed Mar. 21, 1974, now U.S. Pat. No. 3,967,393, granted July 6, 1976.

The present invention is concerned with apparatus for raising high density solids such as gravel in bulk from the bed of a river or a seabed, particularly in depths beyond the range of normal dredging apparatus. A further application of the techniques and apparatus of the invention is a means for establishing an underwater anchorage such as for a surface vessel or for any other structure such as a well-head.

According to the present invention an underwater anchoring apparatus includes a substantially hollow structure submersible in a volume of water and having at least one intake passageway located in the lower region of the structure, the apparatus also including collection means whereby in operation water from the lower strata of the volume of water on or adjacent the bed of the liquid may be induced into the interior of the structure through the intake passageways with sufficient momentum to carry into the interior solid matter from the water bed to cause the structure to become at least partially buried in the water bed.

Preferably the collection means includes a vent passageway located in the upper region of the structure and through which liquid may be extracted from within the interior of the structure by suction means.

The structure might also include an air inlet passageway through which air under pressure may be fed into the interior of the structure to act in conjunction with the vent passageway as an air-lift pump for the extraction of air/water from within the interior of the structure.

In one arrangement of the invention the substantially hollow structure includes a lower platform region with a series of intake passageways arranged in the base of the platform such that solids induced into the structure by the collecting means substantially fill the interior of the platform region and cause it to become at least partially buried in the bed material.

In order that the present invention may be more fully understood an embodiment thereof will now be described by way of example only with reference to the accompanying drawings which illustrate vertical sections through the apparatus of the invention.

Figure 1:
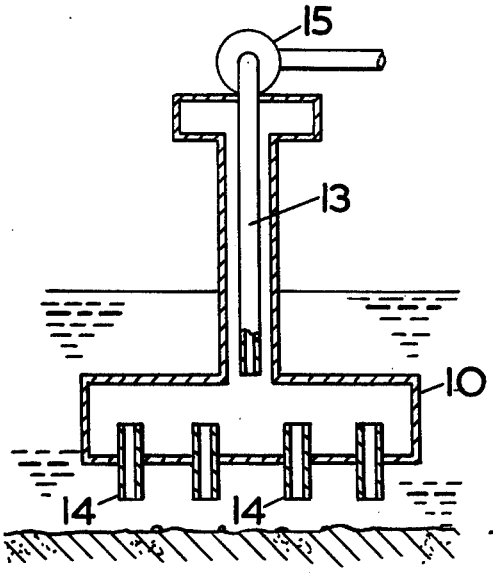
FIG. 1 shows the anchoring apparatus on the surface.
Figure 2:
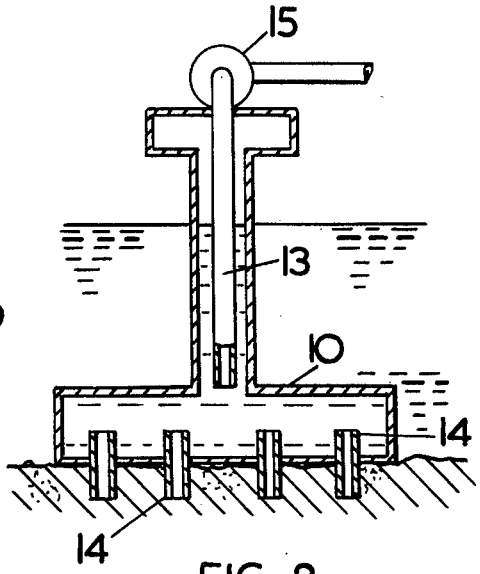
FIG. 2 shows the flooded anchoring apparatus submerged and resting on the water bed.

Referring to FIGS. 1, 2, 3 and 4 the underwater anchoring apparatus in the form of a hollow structure 10 floats on the surface of the water as shown in FIG. 1 until it is located above the site where it is to be anchored. The hollow structure 10 is then flooded and sinks to the water bed as shown in FIG. 2. The water contained within the structure is then expelled in any one or more of a number of ways; for example, by connecting the interior of the structure to the suction pipe of a pump, either submerged or mounted above the surface of the water, or by a water jet ejector, or by an air-lift pump.

Figure 3:
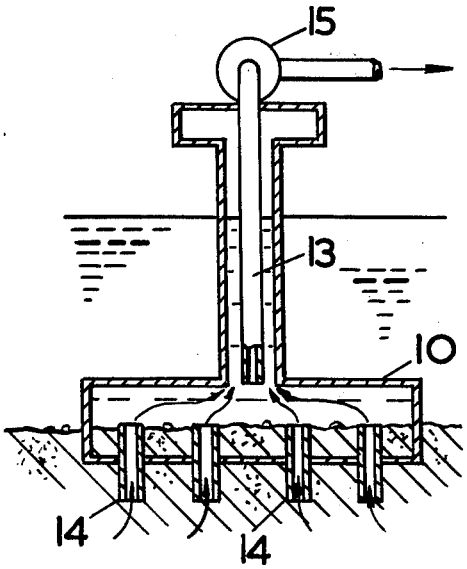
FIG. 3 shows the submerged anchoring apparatus being evacuated of water, which is being replaced by material from the water bed.
Figure 4:
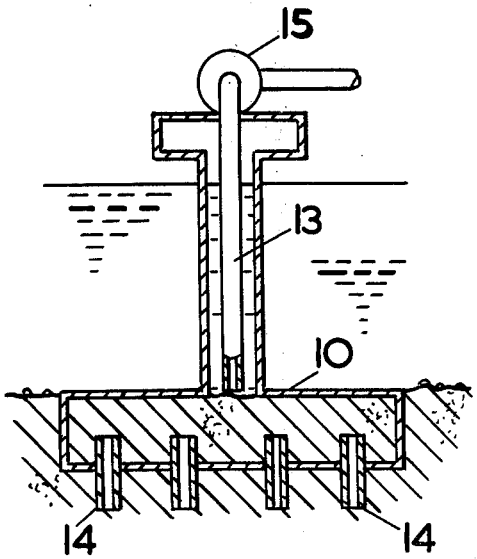
FIG. 4 shows the anchoring apparatus partially buried in the water bed thereby providing a secure anchorage.

As shown in FIG. 3 the water within the hollow structure 10 is expelled through a pipe 13 connected to a water pump 15 whereby liquid is induced into the structure through open substantially unobstructed intake passageways 14 located in the lower region of a platform-like lower portion of the structure 10. The momentum of the water entering through the intake passageways 14 is arranged to be sufficient to carry over solids from the water bed, with which the external portions of the intake passageways 14 are in contact or are adjacent to, into the interior of the structure 10. The velocity within the structure 10 is arranged to be sufficiently low for heavy solids to settle out of suspension once they have entered the structure through the intake passageways 14. This action continues with the platform-like lower portion of the structure 10 gradually filling with material from the water bed and at the same time being buried deeper in the water bed to form a firm anchorage. If the means for expelling the liquid from the interior of the structure is able to handle solids then the process can continue after the structure 10 is full of solid material from the water bed, excess solid material passing out through the pipe 13 and the pump 15 and settling on top of the structure which continues to bury itself, thereby increasing the effectiveness of the structure as an anchorage.

One advantage of using this method to establish an anchoring point is that comparatively little material need be used to construct the structure, the majority of the mass of the anchoring device being provided by the material dredged up from the water bed. Although illustrated as being sunk into bed material beneath relatively shallow water, the anchoring apparatus can obviously be used also in deep water to provide the totally submerged anchorage point. The actual size of the anchorage may vary enormously as the artisan skilled in the art will readily appreciate. At one extreme the anchorage might for example be used to provide a secure mooring for a small boat while at the other extreme the anchorage might constitute for example the whole or a substantial part of an oil rig platform.

I claim:

1. Underwater anchoring apparatus for establishing a means of anchorage in the bed of a volume of water comprising a substantially hollow closed structure submersible in the volume of water, at least two substantially unobstructed intake passageways located in the lower region of said structure, and collecting means operative in use to induce into the interior of said structure through said intake passageways water from the lower strata of said volume of water, said water being induced into said interior and carrying with it into said interior solid matter from the waterbed which solid matter settles in said structure to substantially fill said structure and cause the structure to become at least partially buried in said bed of said volume of water.

2. Underwater anchoring apparatus as claimed in claim 1 in which said collecting means include an extraction passageway in the upper region of the structure through which water in said interior of the structure may be extracted.

3. Underwater anchoring apparatus as claimed in claim 2 including a pump to which said extraction passageway is connected and which is operative in use to extract water from within said structure.

4. Underwater anchoring apparatus as claimed in claim 2 in which said substantially hollow closed structure includes a lower platform-like box portion, said intake passageways being located in the lower region of said platform-like box portion such that solid matter induced into said structure by said collecting means fills or substantially fills the interior of at least said platform-like box portion and causes it to become at least partially buried in the bed of the water.

5. Underwater anchoring apparatus as claimed in claim 4 including a pump to which said extraction passageway is connected and which is operative in use to extract liquid from within said structure.

6. Underwater anchoring apparatus as claimed in claim 4 in which said substantially hollow closed structure includes a substantially vertical portion above said platform-like box portion adapted to act to form an attachment to or connection with an object to be anchored.

7. Underwater anchoring apparatus as claimed in claim 6 including a pump to which said extraction passageway is connected and which is operative in use to extract liquid from within said structure.

8. Underwater anchoring apparatus as claimed in claim 1 in which said substantially hollow closed structure includes a lower platform-like box portion, said intake passageways being located in the lower region of said platform-like box portion such that solid matter induced into said structure by said collecting means fills or substantially fills the interior of at least said platform-like box portion and causes it to become at least partially buried in the bed of the water.

9. Underwater anchoring apparatus as claimed in claim 8 including a pump to which said extraction passageway is connected and which is operative in use to extract liquid from within said structure.

* * * * *